United States Patent [19]

Geurtsen

[11] 4,416,351

[45] Nov. 22, 1983

[54] REEL FOR A LIFE-LINE

[75] Inventor: Alfonsus A. Geurtsen, Deventer, Netherlands

[73] Assignee: Machinefabriek Geurtsen Deventer B.V., Deventer, Netherlands

[21] Appl. No.: 254,215

[22] Filed: Apr. 15, 1981

[30] Foreign Application Priority Data

Apr. 29, 1980 [NL] Netherlands ..... 8002506
Nov. 5, 1980 [NL] Netherlands ..... 8006056

[51] Int. Cl.[3] ..... A62B 1/12

[52] U.S. Cl. ..... 182/238; 182/233; 188/295; 254/377

[58] Field of Search ..... 182/5–9, 182/233, 238; 188/295; 254/377

[56] References Cited

U.S. PATENT DOCUMENTS

| | | | |
|---|---|---|---|
| 516,117 | 3/1894 | Roper | 182/238 |
| 2,035,387 | 3/1936 | Heritier | 188/295 |
| 2,880,825 | 4/1959 | Porter | 188/91 |
| 3,834,671 | 9/1974 | Buisson | 182/233 |
| 3,861,496 | 1/1975 | Hoover | 182/5 |
| 3,879,016 | 4/1975 | Kankkunew | 182/238 |
| 4,018,423 | 4/1977 | Belew | 182/238 |

*Primary Examiner*—Reinaldo P. Machado
*Attorney, Agent, or Firm*—Diller, Ramik & Wight

[57] ABSTRACT

The invention relates to a reel for a life-line comprising a frame, a winding member journalled in said frame so as to be rotatable about a rotary axis, damping means connected on the one hand with the frame and on the other hand with the winding member and counteracting the rotation of the winding member, said damping means comprising at least one cam member and a plurality of piston pumps rotatably co-operating herewith along a relative path of movement with respect to one another and each having a cylinder and a piston displaceable therein and being in contact with the cam member, while of each pair of pumps, whose pistons are moved in opposite senses by the cam member, the cylinders communicate with one another through a channel having a restriction. In order to provide a reel capable of providing powerful damping, which is nevertheless compact, the reel comprises one set of pumps having a plurality of pump pairs which co-operate with the cam member along one and the same relative path of movement and which communicate each with a common channel portion through a restriction.

12 Claims, 4 Drawing Figures

REEL FOR A LIFE-LINE

The invention relates to a reel for a life-line comprising a frame, a winding member journalled in said frame so as to be rotatable about a rotary axis, damping means connected on the one hand with the frame and on the other hand with the take-up member and counteracting the rotation of the winding member, said damping means comprising at least one cam member and a plurality of piston pumps rotatably co-operating with one another along a relative path of movement with respect to one another and each having a cylinder and a piston displaceable in said cylinder and being in contact with the cam member, whilst of each pair of pumps, whose pistons are moved in opposite senses by the cam member, the cylinders communicate with one another through a channel having a restriction.

Such a reel is known from German patent application No. 2,242,101 laid out for public inspection and may be used, in a case of emergency, for escaping from a building on the outside by means of a life-line. For this purpose the reel as a whole is suspended at a suitable place. By seating oneself in a loop connected with the life-line or forming part thereof, one can quietly descend to the ground, since the reel is braked when winding off. Each pair of pumps can provide a given damping power. The damping power is limited by the permissible increase in temperature of the oil during its flow through the restriction. Consequently, if a high damping power is desired, a large number of pump pairs has to be available.

The invention has for its object to provide a reel of the kind set forth in the preamble, which is capable of providing powerful damping and which is nevertheless compact.

According to the invention this is achieved by means of a reel comprising at least one set of pumps having a plurality of pump pairs which co-operate with the cam member along one and the same relative path of movement and which are each in communication with a common channel portion through a restriction. Because in contrast to the known reel a plurality of pump pairs are arranged in one radial plane, the dimensions of the reel are reduced.

An advantageous embodiment of the reel according to the invention is obtained when the pumps extend radially with respect to the rotary axis and a number of pump sets are arranged in adjacent radial planes.

When, in addition, the common channel portions of the pump sets form part of an axially extending, central channel, it is possible in practice to use a large number of pumps. However, this also permits of simply filling the pumps with oil or the like and of bleeding or venting them. Despite the fact that all cylinders communicate with one another the braking operation is not affected when the pumps are correctly disposed.

Since the invention provides a reel of limited dimensions capable of providing a high damping power, this reel is particularly suitable for use aboard a ship for lowering a life-boat. If in the case of a shipping disaster the electric current is failing, a life-boat can nevertheless be braked in lowering and will not touch water with excessive speed so that the risk of turning over of the life-boat is avoided.

Further features and advantages of the invention will become apparent from the following description of embodiments with reference to the drawings.

Figure 1:
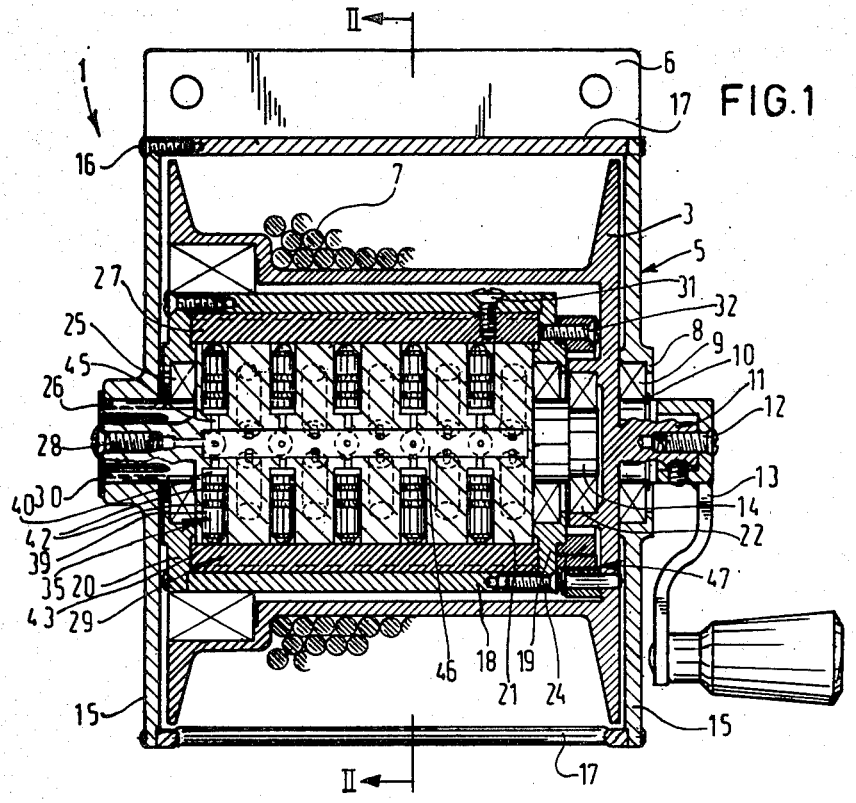
FIG. 1 is a longitudinal sectional view of a preferred embodiment of the reel.

The reel 1 shown in FIG. 1 comprises a winding member 3 journalled in a frame 5. The winding member 3 comprises a life-line 7. In this embodiment the frame 5 comprises two bearing plates 15, between which a hood 17 is arranged by means of bolts 16. On the bottom side the hood has a slot through which the life-line 7 can pass. On the top side the hood 17 has fastened to it a suspension plate 6 by means of which the complete reel can be suspended.

On one side, in FIG. 1 on the right-hand side, the winding member 3 has a stub shaft 11 by which this winding member 3 is journalled in the bearing plate 15 with the aid of a bearing 9. The bearing 9 is locked in the bearing plate 15 by a shoulder 8. The bearing 9 is secured to the stub shaft 11 by means of a guard spring 10. To the end of the stub shaft 11 is fastened a crank 13 by means of a bolt 12. At the other end, the left-hand side in FIG. 1 the winding member 3 is journalled by means of a bearing 23 on a cam housing 29 to be described more fully hereinbelow.

A shaft body 14 is mounted centrally in the frame 5 and in the winding member 3. By the left-hand end, viewed in FIG. 1, the shaft body 14 is non-rotatably fastened in the left-hand bearing plate 15 by means of a key toothing 26. With respect to the bearing plate 15 the shaft body 14 is secured against displacement by means of a guard ring 30, which is fastened to the shaft body 14 by a guard bolt 28. The winding member 3 is journalled on the side of the crank 13 by means of a bearing 22 on the right-hand end of the shaft body 14, viewed in FIG. 1.

The aforesaid cam housing 29 is formed by a right-hand head plate 19, a left-hand plate 20 and a sheath 18. The head plates 19, 20 are integrally connected with the sheath 18 by means of bolts 24. The head plates 19, 20 of the cam housing 29 are journalled by bearings 22 and 25 respectively on the shaft body 14.

Between the head plate 19 of the cam housing 29 and the opposite inner side of the winding member 3 is arranged a free-wheel clutch 47 in the form of a pawl mechanism known per se. The free-wheel clutch 47 is designed so that the winding member 3 with the cam housing 29 is coupled in the direction of rotation when the life-line 7 is wound off the winding member 3. In the opposite direction the pawl mechanism is running freely. Therefore, the life-line 7 can be wound up by means of the crank 13 on the winding member 3, whilst the damping means, part of which is formed by the cam housing 29, are not active.

The damping means comprise apart from the cam housing 29 a cam cylinder 27 arranged in said cam housing 29, a pump housing 21 of the shaft body 14 and a plurality of piston pumps 35 formed therein.

Since the pump housing 21 forms part of the shaft body 14, it remains immovable with respect to the frame 5. In the direction of rotation of the winding member 3, in which the life-line 7 winds off, that is to say, in the direction of rotation in which the winding member 3 carries along the cam housing 29 by the free-wheel clutch 47, this cam housing 29 thus rotates with respect to the pump housing 21.

The cam cylinder 27 fastened in the cam housing 29 by means of a guard bolt 31 comprises a number of radial cams 33, in this embodiment six, which extend throughout the length of the cam cylinder 27.

Although in this embodiment the cam cylinder 27 is shown as a single unit, it may be, as an alternative, an assembly of a number of rings or segments.

The piston pumps 35 are arranged in the pump housing 21 in groups of four pumps in the same radial plane. Each piston pump 35 comprises a piston 39 displaceable in a cylinder 40. The piston 39 has two grooves 42 in which sealing means, for example, O-rings are arranged. In the end of the piston 39 facing the cams 33 is arranged a hard-steel ball 43.

Figure 2:
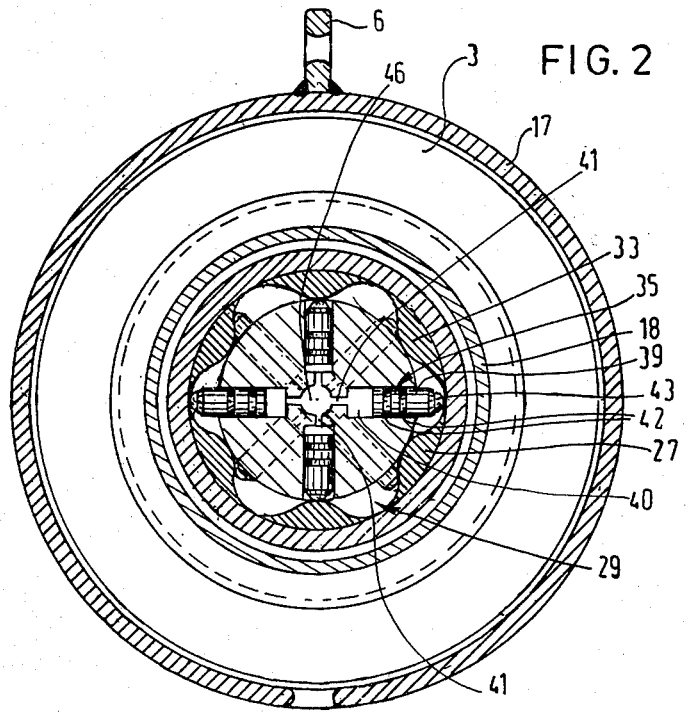
FIG. 2 is a cross-sectional view of the reel taken on the line II—II in FIG. 1.

FIG. 2 illustrates that by the combination of four piston pumps 35 with six cams 33 every two opposite pistons 39 can move outwardly when the two other pistons of one group of four are urged inwardly by the cams 33. For the inward movement of the pistons 39 fluid contained in the associated cylinder 40 is displaced from the cylinder 40 through a channel 45 forming a restriction for said fluid. Said fluid may be oil of suitable viscosity. When said pistons 39 are urged towards one another, the two other pistons 39 of the group of four are urged outwardly by the expeled fluid. With this construction means for maintaining the contact between the pistons and the cams are redundant.

In order to urge inwardly the pistons 39 in the cylinders 40 the cam concerned has to exert a given force on the pistons 39 concerned. This force counteracts the rotation of the winding member 3 and hence unwinding of the life-line 7. By a correct choice of the number of piston pumps 35 in one reel and a correct proportioning of the diameters both of the pistons and the restriction channels a satisfactory damping effect can be obtained.

FIGS. 1 and 2 show that every two adjacent groups of four cylinders 40 are relatively off-set through 45°. It is thus achieved that the damping effect is more uniform i.e. less jerky.

In the embodiment shown all cylinders 40 communicate through the restricted channels 45 with a single, central channel 46. This provides the advantage that the piston pumps 35 can be simply filled with oil and be bleeded. The central channel 46 may be accessible through the bore receiving the bolt 28.

Figure 3:
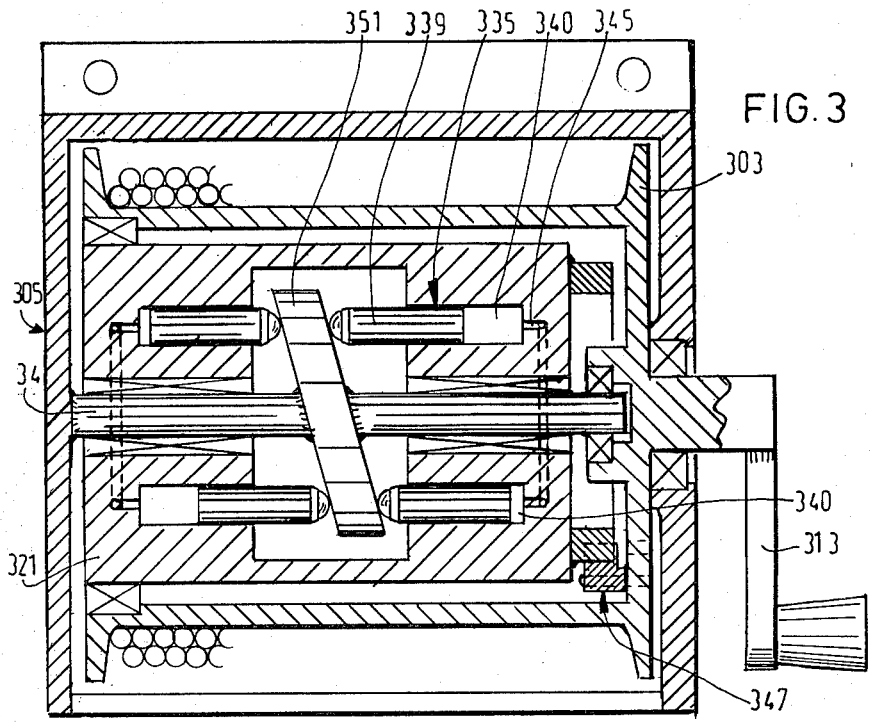
FIG. 3 is a drastically schematic sectional view corresponding to FIG. 1 of a further embodiment and FIG. 4 is a sectional view corresponding to FIGS. 1 and 3 of a still further embodiment.
Figure 4:
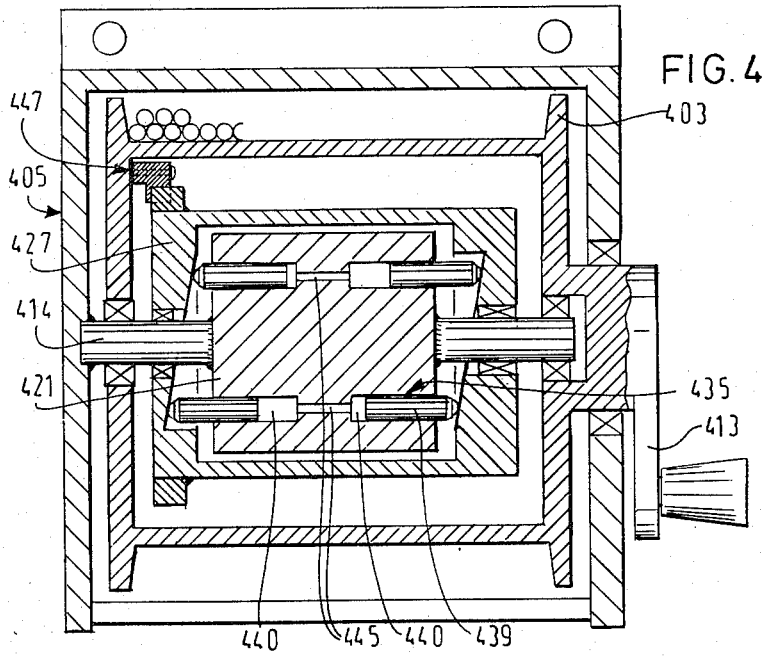

In FIGS. 3 and 4 parts corresponding with parts of FIG. 1 are designated by the same reference numerals preceded by 3 and 4 respectively.

The embodiments schematically shown in FIGS. 3 and 4 differ from that of FIG. 1 in that the piston pumps 335, 435 extend axially. As shown in FIG. 3 a cam disc 351 is positioned between the relatively facing pistons 339 and rigidly secured to the shaft body 314. The cam disc 351 is formed in a very simple manner by a flat disc inclined to the centre line of the reel. The piston pumps 335 communicate with one another through direct channels 345.

As shown in FIG. 4 the pistons 439 are mounted away one another in the pump housing 421. This provides a very simple construction in which the cylinders 440 are directly connected with one another through the respective restriction channel 445. In this embodiment the cam surfaces are formed by an inner surface of the cam cylinder 427.

The operation of the embodiment of FIGS. 3 and 4 fully corresponds with that of FIG. 1, which means that also in this case the damping means are only operative when the life-line 307, 407 is winding off the winding member 303, 403 rotating in the opposite direction.

FIG. 3 illustrates that the piston pumps 335 can be caused to rotate with respect to the shaft body 314 rigidly secured to the frame 305. This possibility is not limited to embodiments comprising axially extending piston pumps, but also applies to embodiments having radial piston pumps as in the embodiment of FIG. 1.

A suitable arrangement of the damping means can be chosen in accordance with the desired external shape of the reel and the dimensions thereof.

What I claim is:

1. A reel for a life-line comprising a frame, a winding member journalled in said frame so as to be rotatable about a rotary axis, damping means connected on the one hand with the frame and on the other hand with the winding member and counteracting the rotation of the winding member, said damping means comprising at least one cam member and a plurality of piston pumps rotatably co-operating herewith along a relative path of movement with respect to one another and each having a cylinder and a piston displaceable therein and being in contact with the cam member, whilst of each pair of pumps, whose pistons are moved in opposite senses by the cam member, the cylinders communicate with one another through a channel having a restriction, characterized by at least one set of pumps comprising a plurality of pump pairs which co-operate with the cam member along one and the same relative path of movement and which communicate each with a common channel portion through a restriction.

2. A reel as claimed in claim 1 characterized in that the pumps extend radially with respect to the rotary axis and in that a number of pumps sets are located in adjacent radial planes.

3. A reel as claimed in claim 2 characterized in that the common channel portions of the pump sets form part of an axially extending, central channel.

4. A reel as claimed in anyone of the preceding claims characterized in that the life-line is coupled with a lifeboat for lowering the same whilst being braked.

5. A reel for a life line comprising a frame, a winding member journalled on said frame and damping means between said winding member and said frame for resisting rotation of the winding member in that direction of rotation which pays out a line wound on said winding member; the improvement wherein said damping means comprises a pump body and cam means mounted for relative rotation with respect to said pump body in response to said rotation of the winding member, said pump body having a first set of at least three cylinder bores which are angularly spaced about the axis of relative rotation between the pump body and the cam means and a first set of pistons in such bores which engage said cam means at spaced, successive points along a first common path of movement due to said relative rotation, said pump body having a second set of at least three cylinder bores which are angularly spaced about said axis of relative rotation and a second set of pistons in such second set of bores which engage said cam means at spaced, successive points along a second common path of movement which is separate from said first common path, and flow restriction means for allowing liquid to flow back and forth between said cylinder bores.

6. A reel as defined in claim 5 wherein said flow restriction means comprises a restricted passage at each cylinder, and a common passage in said pump body with which all of said restricted passages communicate.

7. A reel as defined in claim 6 wherein said first and second sets of cylinder bores are disposed in side-by-side planes perpendicular to said axis of relative rotation.

8. A reel as defined in claim 5 wherein said first and second sets of cylinder bores are disposed in side-by-side planes perpendicular to said axis of relative rotation.

9. A reel as defined in claim 5 wherein the bores of said first and second sets are disposed parallel to said axis of relative rotation.

10. A reel as defined in claim 9 wherein said flow restriction means comprises a restricted passage at each cylinder, a first common passage communicating all of the restricted passages of said first set of cylinder bores and a second common passage communicating all of the restricted passages of said second set of cylinder bores.

11. A reel as defined in claim 9 wherein pairs of said cylinder bores comprising one cylinder bore of each of said first and second sets thereof are directly communicated by said flow restriction means.

12. A reel for a life line comprising a frame, a winding member journalled on said frame about an axis of rotation and damping means between said winding member and said frame for resisting rotation of said winding member; the improvement wherein said damping means comprises a pump body centered on said axis and fixed to said frame, and cam means surrounding said pump body and connected to said winding members for relative rotation with respect to said pump body about said axis of rotation, said pump body having a plurality of sets of angularly spaced cylinder bores, each set being disposed radially within a plane perpendicular to said axis and each set being in a plane spaced axially along said axis from all of the other sets and each set comprising at least two pairs of diametrically opposed cylinder bores, said plug body having a reservoir chamber disposed centrally thereof and extending axially along said axis, each cylinder bore of all of said sets having a restricted passage communicating with said reservoir chamber, a piston in each cylinder bore and projecting therefrom into engagement with said cam means, and a quantity of viscous liquid filling said reservoir chamber, said restricted passages and any volume beneath said pistons whereby to maintain said engagement between the pistons and said cam means.

* * * * *